United States Patent [19]

Bonin

[11] 4,414,945

[45] Nov. 15, 1983

[54] DUAL-RANGE MECHANICAL GOVERNOR FOR FUEL INJECTION PUMPS

[75] Inventor: Jean-Claude Bonin, Blois, France

[73] Assignee: CAV RotoDiesel, Blois, France

[21] Appl. No.: 872,177

[22] Filed: Jan. 25, 1978

[30] Foreign Application Priority Data

Feb. 2, 1977 [FR] France ..... 77 02918

[51] Int. Cl.[3] ..... F02D 1/04

[52] U.S. Cl. ..... 123/368; 123/373

[58] Field of Search ..... 123/139 ST, 140 J, 140 R, 123/179 L, 366, 368, 373

[56] References Cited

U.S. PATENT DOCUMENTS 3,276,439 10/1966 Reichenbach ..... 123/140 R X
3,771,917 11/1973 Davies ..... 123/140 R X
3,970,064 7/1976 Ehem et al. ..... 123/179 L X

FOREIGN PATENT DOCUMENTS 2148762 4/1973 Fed. Rep. of Germany ... 123/140 J

*Primary Examiner*—Tony M. Argenbright

*Attorney, Agent, or Firm*—Finnegan, Henderson, Farabow, Garrett & Dunner

[57] ABSTRACT

A mechanical governor of the so-called "idling and maximum speed governor" type for injection pumps, comprising a governing lever to which is connected the control member for the rate of flow, or metering member, and which is pivotally mounted under the action of a force which is a function of the engine rotation speed, an idling speed spring bearing, on the one hand, on the governing lever and, on the other hand, on an idling speed abutment member, a control lever the position of which determines the engine speed at idling speed and the maximum speed and the load, or rate of flow delivered to the engine, at the intermediate speeds, and a main spring connected, through one of its ends, to the control lever, and through its other end to a rigid piece located at a certain distance of the governing lever, and in such manner as to be engaged with said lever and then to pivot when the control lever is moved from its idling speed position towards its maximum speed position, a regulator wherein the idling speed abutment member and the rigid piece to which is connected the main spring are two distinct parts, so that the idling speed spring is independent of the control lever.

5 Claims, 2 Drawing Figures

DUAL-RANGE MECHANICAL GOVERNOR FOR FUEL INJECTION PUMPS

Injection pumps with rotary distributor of known types comprise a device, called governor, which regulates the rate of flow delivered by the pump to the injection nozzles of the engine when operating as a function on the one hand of the rotation speed of the engine, and on the other hand of the position of a control lever, said control lever being, on a diesel engine vehicle, connected to the accelerator pedal of the vehicle.

Two principles are often applied in such governors for transforming the engine rotation speed parameter into efforts: they relate on the one hand to mechanical or centrifugal governors using the centrifugal force of revolving masses and, on the other hand to hydraulic governors using a hydraulic pressure which is a funtion of the rotation speed.

Amongst the known mechanical governors, two types are used: on the one hand the so-called "all speeds governor" whereby a substantially constant rotation speed of the engine is obtained as a function of the load, the engine speed being then determined by the chosen position of the control lever, and on the other hand the so-called "idling and maximum speed governor or dual-range governor" behaving as the previous speed governor, on the one hand for the idling speed, and on the other hand for the maximum speed, and which between these two ranges provides an engine load which is substantially constant as a function of the rotation speed, the value of the load being determined by the position of the control lever for uses at speeds which are intermediate between the idling speed and the maximum speed.

Such so-called idling and maximum speed governors comprise a governing lever to which is connected the control member for the rate of flow, or metering member, and which is pivotally mounted and movable under the action of a force which is a function of the engine rotation speed, generally through a member with revolving masses acting through the centrifugal force, an idling speed spring bearing on the one hand on the governing lever and on the other hand on an idling abutment member which generally is adjustable, a control lever the position of which determines the engine speed at the idling speed and at the maximum speed and the load, or rate of flow delivered to the engine, at the speeds which are intermediate, and a main spring connected by one of its ends to the control lever and by its other end to a rigid piece located at a certain distance from the governing lever, and in such manner as to be engaged with said lever and then pivot it, when the control lever is moved from its idling speed position towards its maximum speed position.

In such known governors, the idling speed abutment member is precisely the rigid piece to which is connected the main spring, meaning that the idling speed spring which is indispensable for obtaining stable idling speeds is mounted between the governing lever and said rigid piece the position of which depends on that of the control lever.

The result of such a construction is that for a given speed of the engine, which is slightly superior to the idling speed, if the driver has released the control, the beginning of the movement of the control lever, from the idling speed position, provides only a compression of the idling speed spring without imparting any movement to the flow rate metering member, therefore without varying the flow rate. In order to begin to vary the flow rate injected in the engine, the control lever has therefore to be sufficiently moved for suppressing the effort urged by the idling speed spring and make the metering member rigid with the control lever. The stroke of the control lever comprises therefore a "dead stroke" followed by an active stroke and the object of the governor, which is mainly to fixedly connect the control lever and the metering member in all the rotation speeds comprised between the idling speed and the maximum speed governing range, that is to provide a correspondence between any displacement of the control lever with a variation of the flow rate injected into the engine, is only partially reached.

The object of the invention is to improve such known governors of the type hereabove described, by rendering as short as possible the dead stroke of the control lever, and to this effect it provides separation of the idling speed abutment member and of the rigid piece to which is connected the main spring, that is making the idling speed spring independent of the control lever, thereby reducing the dead stroke to a minimum compatible with the idling speed regulation, said minimum being largely inferior to the dead strokes obtained with governors of known type.

The accompanying drawing is an embodiment, which is in no way limitative, of the governor according to the invention on said drawing.

Figure 1:
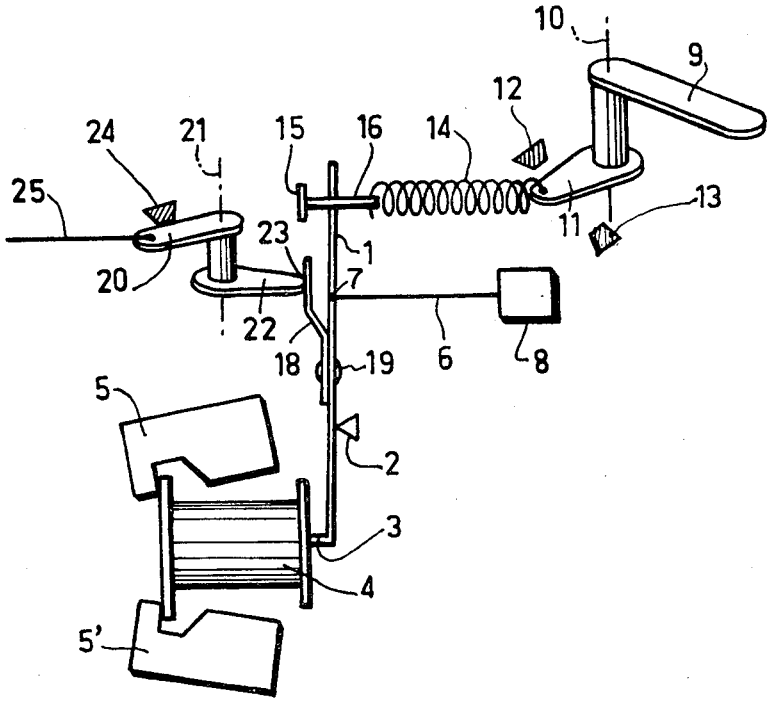
FIG. 1 is a schematic view of the governor according to the invention.

The governor shown in FIG. 1 comprises an engine speed responsive or regulation lever 1 mounted swinging on a knife-edge 2 and connected by its end 3 to engine speed responsive means that includes a sleeve 4 which is movable in translation by masses 5, 5' subjected to the action of the centrifugal force. The rod 6 fixed at 7 to lever 1 connects the latter to a metering member, or flow rate control member 8 of the injection pump. A speed control lever 9 rotatably mounted about an axis 10 is rigid with a stub 11 which is pivotable, within a sector limited by abutment members 12 and 13, when the lever 9 is operated. To stub 11 is fixed at one end thereof a spring 14 which is prestressed and which is the main spring of the governor. The other end of the spring is attached to a head 15 through a rod 16 extending through an opening formed in lever 1 to provide a lost motion connection between levers 1 and 9.

On lever 1 is attached at 19 a blade spring 18, which is the idling speed spring and is engaged at 23 with movable stop means including a cam 22 rigid with an idling control lever 20 and pivotable about axis 21. Said lever 20 may be operated through rod 25 by a servocontrol system means responsive to an engine parameter; for instance a system which is sensitive to the engine temperature, in order to provide an increase of the engine speed when starting under cold conditions. An abutment member 24 provides regulation of the idling speed.

The operation of the governor results immediately from what had been described.

In FIG. 1, the various components of the governor are in the position corresponding to the idling speed operation. The idling speed wherein the engine rotation speed is substantially constant as a function of the load, is stabilized by spring 18 and the idling speed regulation is provided on the one hand by setting the position of the abutment member 24, and on the other hand by moving rod 25 connected to a system which is sensitive for instance to the engine temperature in order to provide an increase of the engine speed when starting under cold conditions.

For a given rotation speed of the engine, slightly superior to the idling speed, the pivoting of the control lever 9, and therefore of stub 11, in the direction from abutment 12 to abutment 13, urges sliding of rod 16 by spring 14 which is then unstressed, and therefore the movement of head 15 until it engages lever 1.

At this moment, rod 6 connected to the metering member 8 becomes fixedly connected to the control lever 9, and this is independent of the characteristics of the idling speed governor.

The "dead stroke" of the control lever 9 is reduced to the minimum which corresponds to the initial distance between head 15 and lever 1. Said distance is a security for the normal operation of the governor at the idling speed.

Figure 2:
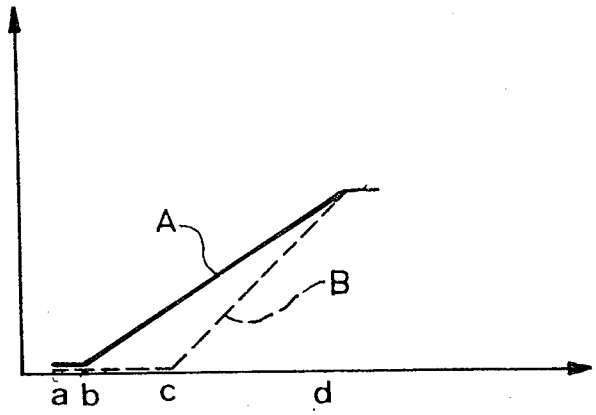
FIG. 2 shows the variation curve of the flow rate delivered to the engine for a constant rotation speed, curve B in dotted line corresponding to a governor of known type, and curve A in solid line to a governor according to the invention.

This appears on the curve A of FIG. 2 where there is a "dead stroke" (a–b) which is very reduced relative to the "dead stroke" (a–c) of the governor of known type. This results, as hereabove explained, from the fact that the idling speed spring 18 is totally independent of the control lever 9.

One can also see in FIG. 2 that for a possible given stroke of the control lever (a–d), that is for a given vehicle, the slope of the straight line representative of the variation of the rate of flow as a function of the displacement of the lever, that is the rate of flow gradient, is lower with the governor according to the invention (curve A) as with the known governor (curve B).

Said two parameters: reduced dead stroke and rate of flow gradient, provide a drive of the vehicle which is smoother than with a governor of known type and permit in particular decreasing substantially the jerks felt when the accelerator pedal is suddenly pressed from its idling speed position.

The invention permits therefore to make the drive of a diesel engine vehicle very close to that of a gasoline engine vehicle, while preserving a governor for the two extreme speeds.

What I claim is:

1. A dual-range mechanical governor for the fuel injection pump of an internal combustion engine having a metering member for controlling the amount of fuel supplied by the pump to the engine, comprising engine speed responsive means, an engine speed responsive lever actuated by the engine speed responsive means and rigidly connected to the metering member to move the same and decrease said fuel amount in consequence of engine acceleration, a manually adjustable speed control lever movable between low speed and high speed positions, a high speed spring connected at opposite ends between said speed responsive lever and said speed control lever, one of said connections being a lost motion connection, said high speed spring exerting a biasing force on said speed responsive lever to increase the amount of fuel supplied by the pump when said lost motion connection is operative, an idling speed spring having one end connected to said speed responsive lever and movable stop means independent of the control lever engagng the other end of said idling speed spring, said idling speed spring exerting a biasing force on said speed responsive lever to increase the amount of fuel supplied by the pump when engaged by the stop means, said lost motion connection permitting movement of the speed responsive lever by the idling speed spring when engaged by the stop means without movement of the speed control lever but which is operative to move said speed responsive lever when said speed control lever is moved towards is high speed position.

2. A governor according to claim 1, including means responsive to an engine operation parameter and connected to said movable stop means thereby to vary the biasing force exerted by said idling speed spring on the speed responsive lever dependent on said operation parameter.

3. A governor according to claim 2, wherein said means is responsive to engine temperature.

4. A governor according to claim 1, wherein the lost motion connection comprises a rod connected at one end to the high speed spring and extending through an opening in the speed responsive lever, said rod having a head attached to the other end of rod and on the side opposite the spring whereby the lost motion connection is operative to move the speed responsive lever when the head is brought into engagement with it in response to movement of the speed control lever.

5. A dual-range mechanical governor for the fuel injection pump of an internal combustion engine having a metering member for controlling the amount of fuel supplied by the pump to the engine comprising engine speed responsive means, a pivotally mounted engine speed responsive lever actuated by the engine speed responsive means and rigidly connected to the metering member so that movement of the lever by the engine speed responsive means will move the metering member and decrease the amount of fuel as a consequence of engine acceleration, a manually adjustable speed control lever movable between low speed and high speed positions, a high speed spring connected at opposite ends between said speed control lever and said speed responsive lever on a side of the pivot opposite from the engine speed responsive means, said connection to the speed responsive lever being a lost motion connection comprising a rod connected at one end to the high speed spring and extending through an opening in the speed responsive lever and having a head attached to the opposite end, said connection being operative to move said speed responsive lever when the rod is pulled through the opening in response to movement of the speed control lever toward its high speed position and the head engages the lever, an idling speed spring having one end connected to said speed responsive lever on a side opposite from the speed control lever and an idling control lever independent of the speed control lever for engaging the other end of said idling speed spring, said idling speed spring exerting a biasing force on said speed responsive lever to increase the amount of fuel supplied by the pump when engaged by said idling control lever, said lost motion connection permitting movement of the speed responsive lever by the idling speed spring without imparting movement to the speed control lever but which becomes operative to move said speed responsive lever when said speed control lever is moved toward its high speed position.

* * * * *